US005243798A

United States Patent [19]

Elliott

[11] Patent Number: 5,243,798

[45] Date of Patent: Sep. 14, 1993

[54] EDGE INSTALLATION FOR SHEET FLOOR COVERING

[76] Inventor: Jimmy R. Elliott, 3284 W. 4900 So., Roy, Utah 84067

[21] Appl. No.: 946,386

[22] Filed: Sep. 17, 1992

[51] Int. Cl.[5] ..... E04B 1/00

[52] U.S. Cl. ..... 52/273; 52/287

[58] Field of Search ..... 52/273, 276, 287, 35

[56] References Cited

U.S. PATENT DOCUMENTS 1,739,077 12/1929 Lisher et al. .
3,192,576 7/1965 Wieting .
4,478,017 10/1984 Brown et al. ..... 52/273 X
4,601,149 7/1986 Dokan ..... 52/287

*Primary Examiner*—Carl D. Friedman
*Assistant Examiner*—Creighton Smith
*Attorney, Agent, or Firm*—A. Ray Osburn

[57] ABSTRACT

A long, narrow, wedge shaped finishing member is installed secured to the underside of sheet floor covering and to the upper surface of the underlying floor structure. The wedge is relatively thick in its wall side thinning to a parallel, opposite feather edge. Butted against vertical surfaces such as bathtub sides or bathroom walls, it provides a downwardly sloping strip to drain away pooled water from the critical edge portion of the floor installation, preventing penetration and floor bonding failures.

5 Claims, 4 Drawing Sheets

EDGE INSTALLATION FOR SHEET FLOOR COVERING

BACKGROUND OF THE INVENTION

1. Field

The field of the invention is floor covering installations using vinyl and linoleum sheeting, and more particularly such installations at junctures of the edges of the sheeting with upstanding walls, bathtubs, door sills and the like.

2. State of the Art

It has been customary to use finishing members beneath the edge portions of linoleum and vinyl floor covering sheets at walls to hide rough cut edges, and to forestall perimeter water damages. Finishing members have been in the form of elongate coves formed of wood or molded of plastic materials, such as disclosed in U.S. Pat. Nos. 1,739,077 and 3,192,576. Such coves provide a vertical back side that abutts the wall, along with an outwardly facing concave portion and a flat underside which is secured to the associated underlying floor structure. Typically, the floor covering sheet is bent to conform to the cove and to extend up the wall a few inches. A downwardly opening metal or plastic flashing is commonly fastened to the wall to cover the unsightly cut edge of the sheet. Corner flashings seal gaps created by the necessary notching of the sheet to fit the molding in these areas. At bathtubs, flooring sheets commonly butt horizontally against upstanding tub sides. Such joints are caulked to hopefully prevent water penetration, but nevertheless frequently result in water damage. Other dangerous areas include dishwasher and laundry installations, the sills of sliding glass doors and shower stalls. Cove molding is not adaptable to many of these problems, and is in any event overly complex and expensive.

An improved system is needed for more effective and economical sealing of the edges of water impervious sheet floor coverings against water damage.

BRIEF SUMMARY OF THE INVENTION

The present invention eliminates or substantially alleviates the foregoing disadvantages and shortcomings in prior art sheet floor covering installations, by providing a sheet edge installation which prevents pooling of water, and which eliminates sheet notching at corners, so as to avoid creating additional cut edge areas requiring sealing against water. This construction substantially eliminates sheet edge water damage.

A narrow, elongate, thin, wedge-shaped finishing member is installed secured to the underside of the covering and to the upper surface of the underlying floor structure. The wedge is relatively thick at its wall side, thinning to a parallel, opposite feather edge. It is butted against vertical surfaces such as bathtub sides, or bathroom walls.

The finishing wedge is preferably installed with its thick edge aligned vertically below the inside edge of baseboard moldings, if present, which rest upon the upper surface of the sheet. With all installations, the sheet upper surfaces at the edge slope everywhere away from the vertical joining walls and surfaces causing water to flow positively away from these vulnerable sheet edge areas, rather than penetrating the joints to cause perimeter water damage.

The wedge finishing member is quite shallow, and its cross taper quite gradual, so that the sheet conforms easily to the upper surface of the wedge without being cut to fit, even at the corners.

It is therefore the principal object of the invention to provide more effective edge installations for sheet flooring materials at walls and other vertical surfaces, which are economical and effectively prevent edge water damage.

BRIEF DESCRIPTION OF THE DRAWINGS

In the drawings, which represent the best modes presently contemplated for carrying out the invention.

DETAILED DESCRIPTION OF ILLUSTRATED EMBODIMENTS

Figure 1:
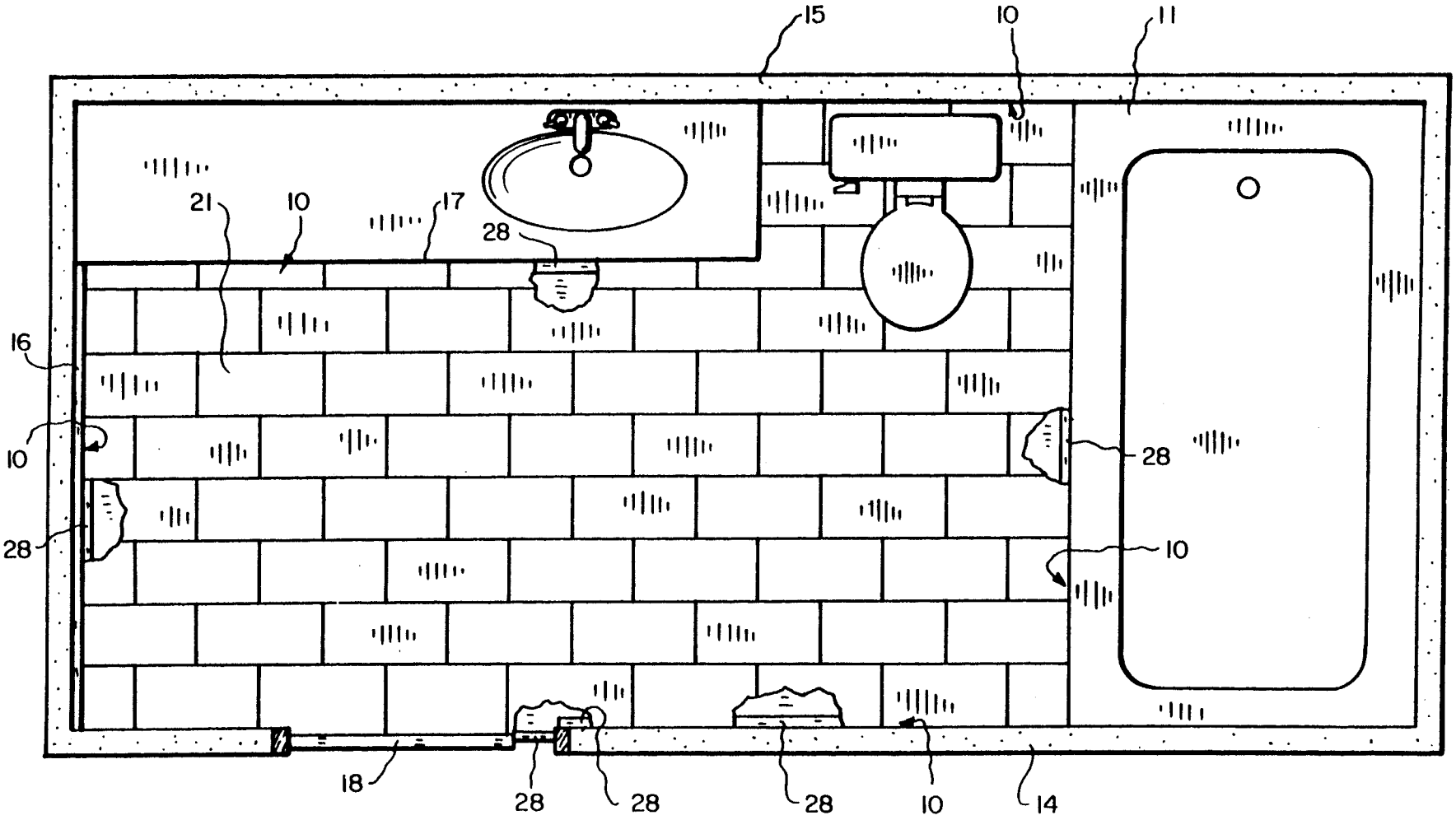
FIG. 1 is a plan view of a bathroom employing a waterproof sheet flooring, said Figure indicating various applications of the edge installation of the present invention, drawn to a reduced scale.

FIG. 1 is a plan view of a typical dwelling house bathroom, illustrating several common flooring edge areas for use of sheet flooring edge installation 10 to prevent water damage. These include side 11 of tub 12, the bathroom walls 14, bathroom walls with a baseboard 16, vanity cabinet walls 17, and doorsill 18. Not indicated are washing machine installations, also posing critical water damage problems for floors.

The floors of bathrooms variously comprise water impervious vinyl sheeting, linoleum, or the like. Whatever sheet covering is used, the junctions of its edges with tubs, bathroom walls and the like all present risk of water damage. Water which manages to penetrate joint cracks may destroy floor cover adhesives, causing sheet separation, curling and cracking. Sustained long-term penetration may soak and subsequently rot underlying flooring boards.

Figure 10:
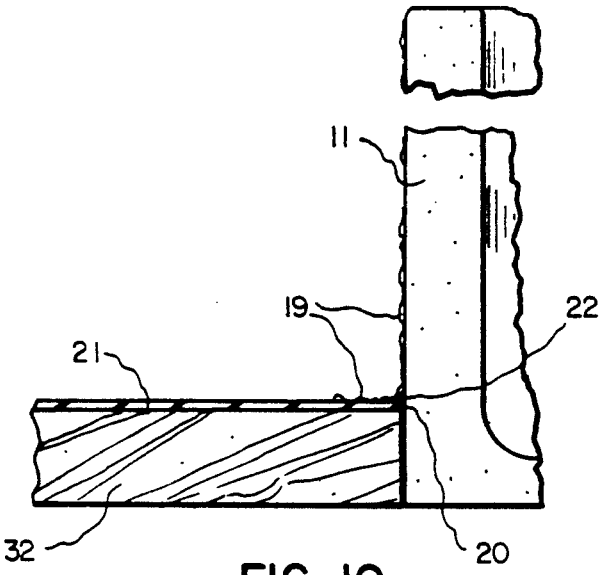
FIG. 10 (PRIOR ART)

Prior art FIG. 10 indicates a typical prior art installation at a bathtub wall 11. Water 19, spilling from the tub during use or cleaning, flows down wall 11 to collect and pool at its junction with edge 20 of floor covering sheet 21. A caulking compound fillet 22 used to seal the junctions often cracks or separates from wall 11, allowing water penetration. Even tiny cracks of capillary size are harmful, because the water tends to wick therealong and eventually penetrate the junction.

Figure 11:
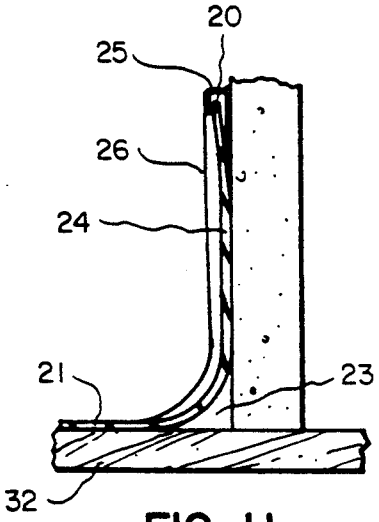
FIG. 11 (PRIOR ART)
Figure 12:
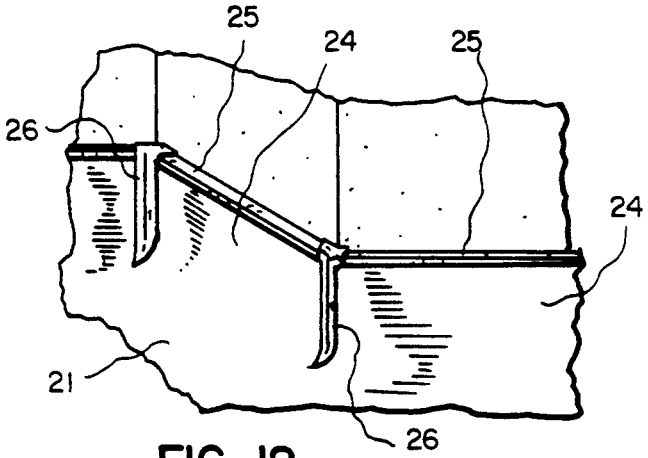
FIG. 12 (PRIOR ART)
Figure 13:
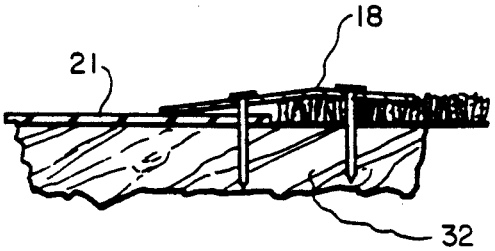
FIG. 13 (PRIOR ART)
Figure 14:
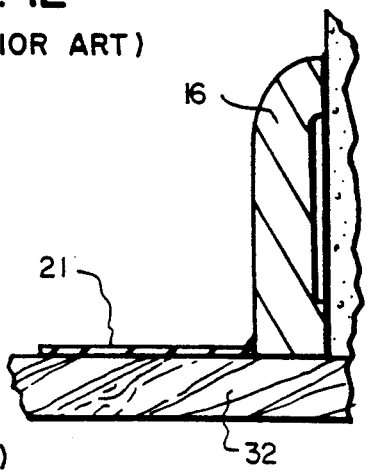
FIG. 14 (PRIOR ART)

At floor-to-wall junctions, a complexly shaped cove member 23 is commonly used. (Prior art FIGS. 11.& 12) Floor covering sheet 21 is notched at each corner, so that a wide strip 24 may be curled up to the wall to avoid wetting of its edge 20, concealed by plastic or metal flashing 25. The notching at each corner creates additional water vulnerable edges, which extend down to the lower floor level. Sheeting gaps are concealed by corner flashings 26. FIGS. 13 and 14 indicate prior art floor installations at a door sill 18 and a wall with a baseboard molding 16.

Figure 7:
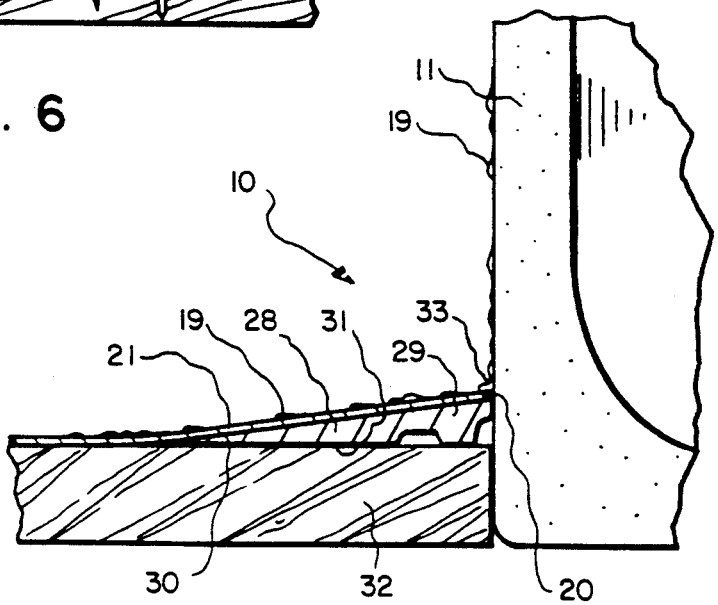

Edge installation 10 is shown installed about the perimeter of the bathroom of FIG. 1. Wedge finishing member 28 is revealed by flooring cutaways at tub 11, walls 14 and 15, doorsill 18, and vanity wall 17. The tub installation is seen in vertical cross section in FIG. 7, drawn to essentially full scale. The thin, wedge-shaped finishing member 28 is bonded to the undersurface of sheeting 21 at edge 20. Thick side 29 of wedge 28 is butted against tube wall 11, so that its opposite, essentially feathered, edge 30 lies outwardly away from the tub. Wedge bottom surface 31 is bonded to flooring structure 32. A bead of sealant 33, preferably rubberoid, may be used at the junction of sheet edge 20 and tub wall 11.

Figure 2:
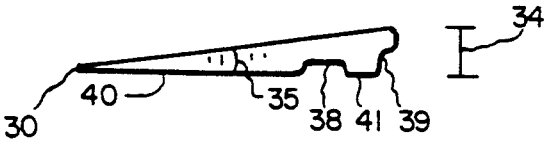
FIG. 2 is cross sectional view of a feather wedge finishing member in accordance with the invention, drawn to approximately full scale, FIG. 3 a perspective view of fragments of two sections of the finishing member of FIG. 2 shown in joining, mitered relationship, drawn to the scale of FIG. 2, FIG. 4 a bottom view of a fragment of the finishing member of FIG. 2, drawn to the same scale, FIG. 5 a cross sectional view of another acceptable embodiment of a finishing member employed in the invention, drawn to the scale of FIG. 2, FIG. 6 a vertical cross sectional view of an edge installation in accordance with the invention, employed in combination with the sill of a doorway, drawn to the scale of FIG. 2, FIG. 7 a cross sectional view of an edge installation in accordance with the invention used in conjunction with the upstanding wall of the bathtub, drawn to the scale of FIG. 2, FIG. 8 a perspective view of an edge installation in accordance with the invention, used in conjunction with a wall baseboard, said installation shown extending around the intersection of two walls, drawn to the scale of FIG. 2, FIG. 9 a cross sectional view of the installation of FIG. 8, taken along line 9—9 thereof, drawn to the scale of FIG. 2, showing the conformance of the sheet covering to the contours of the mitered, joining finishing members, drawn to the scale of FIG. 2, FIG. 10 a cross sectional view of a state of the art installation at a bathtub wall, drawn to the scale of FIG. 2, FIG. 11 a vertical cross sectional view of an installation utilizing a prior art cove finishing member, drawn to a smaller scale than that of FIG. 2, FIG. 12 a perspective view of an edge installation utilizing the cove of FIG. 11, drawn to a reduced scale, FIG. 13 a prior art installation of a flexible sheet floor covering at the sill of a door, drawn to a slightly smaller than FIG. 2, and FIG. 14 a vertical cross sectional view of a prior art edge installation at a wall carrying a baseboard, drawn to the approximate scale of FIG. 2.

The effectiveness of installation 10 stems from the shape of finishing member 28 and from its limited height 34 and small taper angle 35. (FIGS. 2–4) A gradual but positive downward slope from, for example, tub wall 11 outwardly toward the center of the floor assures that any water must flow promptly away from the sheet edge 20. State of the art installations at tubs, for example, typically provide no downward grade away from water vulnerable cover edges 20.

Figure 3:
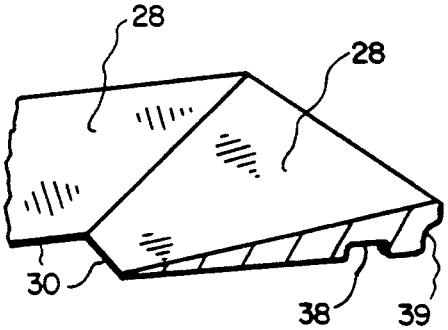
Figure 4:
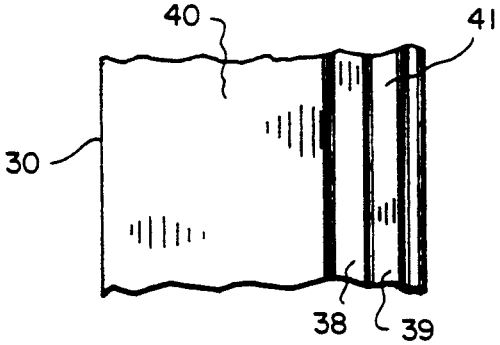

Because the wedge 28 is shallow and wide, the sheet 21 is not severely stressed when shaped to conform and be bonded thereto, nor are the sheet to wedge bonds heavily taxed. Excessively steep, thick wedges would resembly state of the art cove configurations, and have similar attendant problems, requiring running the sheet up the wall and notching the sheet at the corners. Corner notching is not required with the shallow finishing wedges 28 of installation 10. Sheet 21 is easily bent to conform to abutted mitered wedges 28 at corners. Thus, the integrity of the sheet edge seal is maintained at such corners. (FIGS. 3, 8 and 9)

Although acceptable sizes and shapes of the wedges 28 cannot be precisely specified nor limited, important limiting dimensions are strongly indicated by experience. For example, a wedge height 34 of at least 3/16" appears necessary to provide sufficient height for the required downward slope. Heights of ½ or 9/16" began to create bonding problems between wedge and sheet, especially at corners, and are wasteful of wedge material. Whatever height is used, the wedge angle 35 preferably should not exceed 15°, to obviate any bonding stress problems. To efficiently utilize wedge material, provide a reliable bonding angle, and obviate corner bonding problems, a height of ¼", along with a width 36 of about 1 15/16" and an associated wedge angle 35 of about 7½°, has proven to be a near optimum configuration for wedge finishing member 28.

Figure 8:
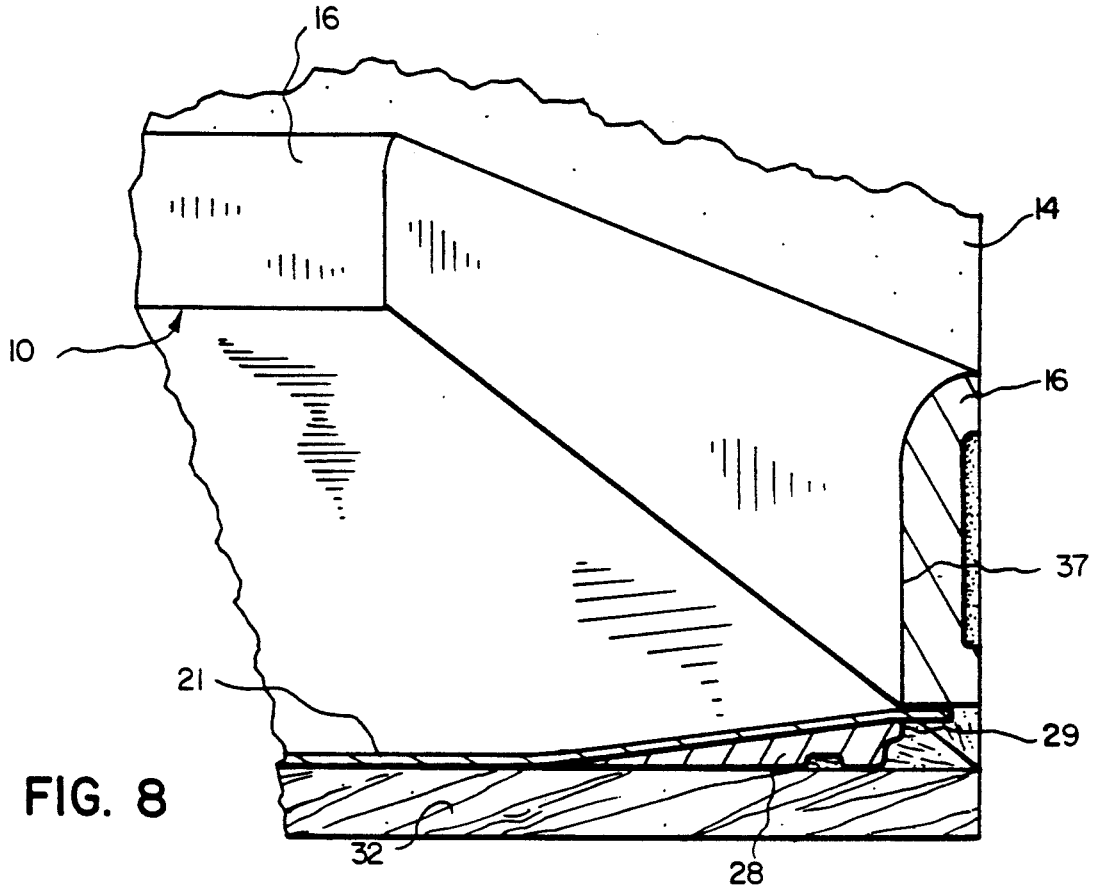
Figure 9:
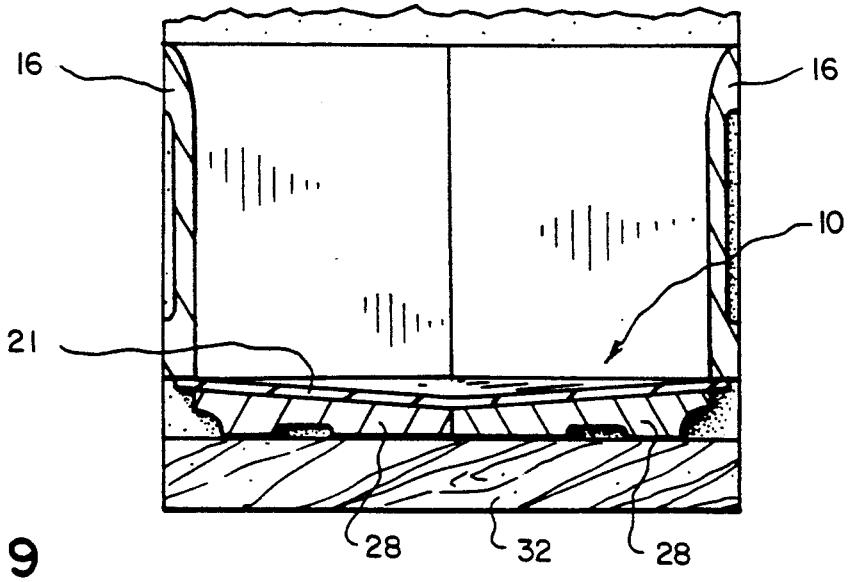

In FIG. 8, an edge installation 10 is shown at an interior wall face 14 having a baseboard molding 16. Wedge member 28 is installed separated somewhat from wall 14, with its thicker edge 29 vertically in line with outer side 37 of molding 16. Floor covering sheet 21, secured to feather wedge 28, extends beneath the baseboard a short distance toward the wall. Baseboard 16 is installed with its outside bottom edge snugly down upon sheet 21, which slopes immediately therefrom down and away to drain water from the joint.

Figure 6:
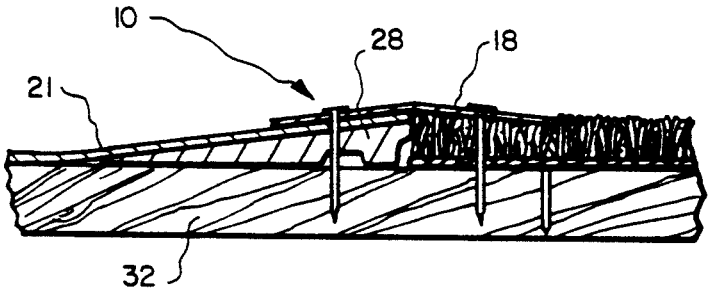

An essentially similar installation 10 is used at doorsills 18 with thicker edge 29 of feather wedge 28 extending beneath the sill. (FIG. 6)

Figure 5:
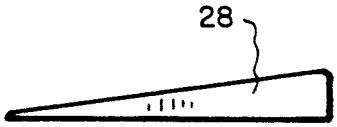

Cutouts 38 and 39 along the bottom 31 of finishing wedge 28 serve to decrease the amount of required material, while maintaining strong base portions 40 and 41 for securement to the floor and support upwardly thereupon. (FIGS. 2–4) However, plain wedge shapes would be equally functional. (FIG. 5)

Feather finishing member 28 is preferably made by extrusion of polyvinyl chloride plastic for light weight, economy, good workability and durability. Other plastics, wood and even metal may also be functionally acceptable.

The invention may be embodied in other specific forms without departing from the spirit or essential characteristics thereof. The present embodiments are therefore to be considered as illustrative and not restrictive, the scope of the invention being indicated by the appended claims rather than by the foregoing description, and all changes that come within the meaning and range of equivalency of the claims are therefore intended to be embraced therein.

What is claimed and desired to be secured by United States Letters Patent is:

1. An installation for an edge portion of a flexible, water impervious, floor covering sheet at a junction of a horizontal underlying floor structure with a vertical structure, said installation comprising:

a finishing member having a vertically extending side facing the vertical structure, said member having an uppermost edge joined to an upwardly facing essentially feathered planar surface, said feathered edge also joining with a horizontal, downwardly facing planar surface bearing upon the underlying floor structure beneath the finishing member;

means securing the finishing member to the underlying floor structure; and adhesive means securing the upwardly facing planar surface to the floor covering sheet.

2. The installation of claim 1, wherein:

the finishing member is installed with at least a portion thereof at the uppermost edge thereof abutting the vertical structure; and the floor covering sheet extends to abut against the vertical structure adjacent said uppermost edge of the finishing member.

3. The installation of claim 1, wherein:

the vertical structure includes a baseboard with a horizontal outermost lower edge bearing upon the floor covering sheet;

the finishing member is secured to the underlying floor structure with the uppermost edge thereof aligned vertically below the horizontal outermost edge of the baseboard; and an edge portion of the floor covering sheet extends beyond said edge of the baseboard toward the vertical structure.

4. The installation of claim 1, wherein:

the horizontal planar surface joining the feathered edge of the finishing member extends horizontally unbroken to join the vertically extending side facing the vertical structure.

5. The installation of claim 1, wherein the horizontal planar surface joining the feathered edge of the finishing member extends partially the width of said finishing member, and said finishing member further comprises:

at least one additional planar horizontal surface portion parallel to, co-planar with and horizontally spaced apart from, the feathered edge joining portion.

* * * * *

UNITED STATES PATENT AND TRADEMARK OFFICE

CERTIFICATE OF CORRECTION

PATENT NO. : 5,243,798

DATED : 09/14/93

INVENTOR(S) : Elliott, Jimmy

It is certified that error appears in the above-indentified patent and that said Letters Patent is hereby corrected as shown below: -

Column 4, Claim 1, line 8, after the word "feathered" please insert --edge--.

Signed and Sealed this

First Day of November, 1994

Bruce Lehman

*Attest:*

BRUCE LEHMAN

*Attesting Officer*

*Commissioner of Patents and Trademarks*